US012571178B2

(12) United States Patent
Fick et al.

(10) Patent No.: US 12,571,178 B2
(45) Date of Patent: Mar. 10, 2026

(54) PIN COUPLER WITH SAFETY LOCK

(71) Applicant: Brandt Industries Canada Ltd., Regina (CA)

(72) Inventors: Adam Fick, Nisku (CA); Bryan Melnyk, Nisku (CA)

(73) Assignee: Brandt Industries Canada Ltd., Regina (CA)

( * ) Notice: Subject to any disclaimer, the term of this patent is extended or adjusted under 35 U.S.C. 154(b) by 1033 days.

(21) Appl. No.: 17/506,987

(22) Filed: Oct. 21, 2021

(65) Prior Publication Data

US 2023/0131971 A1 Apr. 27, 2023

(51) Int. Cl.
*E02F 3/36* (2006.01)

(52) U.S. Cl.
CPC ..... *E02F 3/3622* (2013.01); *E02F 3/3618* (2013.01); *E02F 3/3627* (2013.01); *E02F 3/364* (2013.01); *E02F 3/3663* (2013.01)

(58) Field of Classification Search
CPC ..... E02F 3/36; E02F 3/3604; E02F 3/3622; E02F 3/3627; E02F 3/3631; E02F 3/364; E02F 3/365; E02F 3/3663
USPC ..... 37/468
See application file for complete search history.

(56) References Cited

U.S. PATENT DOCUMENTS 7,240,441 B2 7/2007 McCoy
8,262,310 B2 * 9/2012 Sikorski ..... E02F 3/3618 37/468
2007/0039213 A1 2/2007 Miller
2010/0031539 A1 * 2/2010 Daraie ..... E02F 3/365 37/468
2010/0172732 A1 7/2010 Daraie et al.
2011/0229257 A1 9/2011 Miller
2013/0160268 A1 * 6/2013 Parker ..... E02F 3/3668 403/321
2013/0164080 A1 * 6/2013 Miller ..... E02F 3/3604 403/373
2014/0294497 A1 * 10/2014 Robl ..... E02F 3/365 403/376
2016/0102444 A1 4/2016 Toraason et al.
2016/0201290 A1 * 7/2016 O'Connor ..... E02F 9/26 403/376

(Continued)

FOREIGN PATENT DOCUMENTS

CA 2587065 11/2007

*Primary Examiner* — Joseph M Rocca
*Assistant Examiner* — Audrey L Lusk
(74) *Attorney, Agent, or Firm* — Frost Brown Todd LLP; Nicole M. Tepe

(57) ABSTRACT

A pin grabber coupler for coupling an attachment with an excavator having a housing at least between the plates; a rear receiving arch and a forward receiving arch formed by the spaced-apart plates for receiving a pin of the attachment; a wedge lock extending between the spaced-apart plates; and a main actuator driving the wedge lock into the rear receiving arch and retracting the wedge lock from the rear receiving arch. A locking system for locking or unlocking the wedge lock has a latch having a latch end, a lever end, and a pivot therebetween; the latch end engaging the wedge lock once the wedge lock is fully extended into the rear receiving arch; a biasing member coupled to the lever end and biasing the latch end towards the wedge lock; and an unlock actuator opposing the biasing member to disengage the latch end from the wedge lock.

16 Claims, 4 Drawing Sheets

(56) References Cited

U.S. PATENT DOCUMENTS

| | | | | |
|---|---|---|---|---|
| 2017/0067223 | A1* | 3/2017 | Tsukada | E02F 3/3622 |
| 2020/0080577 | A1* | 3/2020 | Lee | E02F 3/3627 |
| 2020/0263382 | A1* | 8/2020 | Anderson | E02F 3/3622 |

* cited by examiner

PIN COUPLER WITH SAFETY LOCK

FIELD

This invention is in the field of quick couplers for excavators and the like, and more specifically to a pin grabber coupler.

BACKGROUND

U.S. Pub. No. 2007/0039213 discloses a non-removable safety pin for an excavator coupler for securing a latching hook thereof. The safety pin comprises a head, a shaft, a distal end and a longitudinal axis starting at the head, extending along the shaft and terminating at the distal end, wherein either or both of the shaft and the distal end are keyed so as to have an element thereon that extends relative to a side of the shaft. The element prevents removal of the safety pin from a hole in which the safety pin is inserted.

U.S. Pub. No. 2010/0031539 discloses a lock system for a coupler includes at least a first safety lock that is movably connected to the frame and that moves relative to the first hook between an engaged position for capturing the first associated attachment pin in the first hook and a disengaged position for releasing the first associated attachment pin from the first hook. An actuator is adapted to move the first safety lock selectively between its engaged and disengaged positions. At least a first lock arm is movably connected to the frame. The first lock arm is movable between a locked position and an unlocked position. The first lock arm engages and retains the first safety lock in its engaged position when the first lock arm is in its locked position. The first lock arm is selectively movable from its locked position to its unlocked position by contact between a portion of the first lock arm and the associated backhoe or excavator arm when the frame is moved to a curled position relative to the associated backhoe or excavator arm.

U.S. Pub. No. 2010/0172732 discloses a coupler with first and second safety locks movably connected to the frame and move relative to the first hook between an engaged position for capturing the first associated attachment pin in the first hook and a disengaged position for releasing the first associated attachment pin from the first hook. An actuator is adapted to move the safety locks selectively between the engaged and disengaged positions. First and second safety cams are provided and comprise respective cam profiles that respectively: (i) block movement of the first and second safety locks from their engaged positions to their disengaged positions when the frame and first and second safety cams are arranged in a first angular orientation relative to each other; and, (ii) allow movement of the first and second safety locks from their engaged positions to their disengaged positions when the frame and first and second safety locks are arranged in a second angular orientation relative to each other.

U.S. Pub. No. 2011/0229257 discloses a non-removable safety pin for an excavator coupler for securing a latching hook thereof. The safety pin comprises a head, a shaft, a distal end and a longitudinal axis starting at the head, extending along the shaft and terminating at the distal end, wherein either or both of the shaft and the distal end are keyed so as to have an element thereon that extends relative to a side of the shaft. The element prevents removal of the safety pin from a hole in which the safety pin is inserted.

Canadian Pat. No. 2587065 discloses a safety locking device for a quick hitch/coupler of an earth working machine. The safety locking device has a locking element which is biased into a locking position to automatically lock a front pin of an implement when it is engaged in the hook of the coupler. The safety locking device has an hydraulic operable mechanism to move the locking element to an unlocking position. The hydraulic supply to the safety locking device is independent of the hydraulic supply to a locking mechanism of the coupler.

SUMMARY

Any and/or all aspects described herein may be combined in any and/or all combinations.

According to an aspect, there is provided a pin grabber coupler for coupling an attachment with an excavator. The coupler may comprise a pair of spaced-apart plates; a housing at least between the spaced-apart plates; a rear receiving arch and a forward receiving arch formed by the spaced-apart plates for receiving a pin of the attachment; a wedge lock extending between the spaced-apart plates; and a main actuator driving the wedge lock into the rear receiving arch and retracting the wedge lock from the rear receiving arch. The wedge lock may move from an interior of the housing to an exterior of the housing by the main actuator. The wedge lock may have a tapered end for engaging the pin of the attachment.

In an aspect, a locking system may lock or unlock the wedge lock. The locking system may have a latch having a latch end, a lever end, and a pivot therebetween; the latch end engaging the wedge lock once the wedge lock is fully extended into the rear receiving arch; a biasing member coupled to the lever end and biasing the latch end towards the wedge lock; and an unlock actuator opposing the biasing member to disengage the latch end from the wedge lock.

The biasing member may be a spring coupled between the housing and the lever end. The unlock actuator may be a hydraulic cylinder acting on the lever end of the latch. The main actuator may be a hydraulic cylinder and a ram coupled to the wedge lock.

A visual indicator may be coupled to the wedge lock such that when the wedge lock is retracted from the rear receiving arch, the visual indicator protrudes from the housing; and when the wedge locked is fully extended into the rear receiving arch, the visual indicator is within the housing.

The locking system may be within the housing forward of the rear receiving arch and behind the forward receiving arch.

Each of the spaced-apart plates may comprise an upper plate and a lower plate. The upper plates may be spaced apart with a larger distance than the lower plates. The upper plates may be substantially parallel to each other and the lower plates may be substantially parallel to each other. A stepped ridge may separate each of the upper plates from each of a corresponding each of the lower plates. The housing may be at least between the lower plates. The rear receiving arch and the forward receiving arch may be formed by the lower plates for receiving the pin of the attachment.

Each of the upper plates may comprise at least one hole passing transvers through the upper plates for receiving a mounting pin that fixes the pin grabber coupler to the excavator. The at least one hole may comprise a pair of rear retaining holes and a pair of forward retaining holes. The at least one hole may comprise a flange extending outward from each of the upper plates around a circumference of each of the at least one hole.

According to an aspect, there is provided, a method of locking a pin grabber coupler for coupling an attachment with an excavator. The method may comprise biasing a latch end of a latch towards a wedge lock; actuating a main actuator to drive the wedge lock into a rear receiving arch across a pin of the attachment; and engaging the latch end with the wedge lock once the wedge lock is fully extended into the rear receiving arch.

According to another aspect, there is provided a method of unlocking a pin grabber coupler for coupling an attachment with an excavator. The method may comprise biasing a latch end of a latch towards a wedge lock; actuating a main actuator to drive the wedge lock into a rear receiving arch across a pin of the attachment; engaging the latch end with the wedge lock once the wedge lock is fully extended into the rear receiving arch; and actuating an unlock actuator opposing the biasing of the latch end to disengage the latch end from the wedge lock.

BRIEF DESCRIPTION OF THE DRAWINGS

While the invention is claimed in the concluding portions hereof, example embodiments are provided in the accompanying detailed description which may be best understood in conjunction with the accompanying diagrams where like parts in each of the several diagrams are labeled with like numbers, and where:

DETAILED DESCRIPTION

Figure 1:
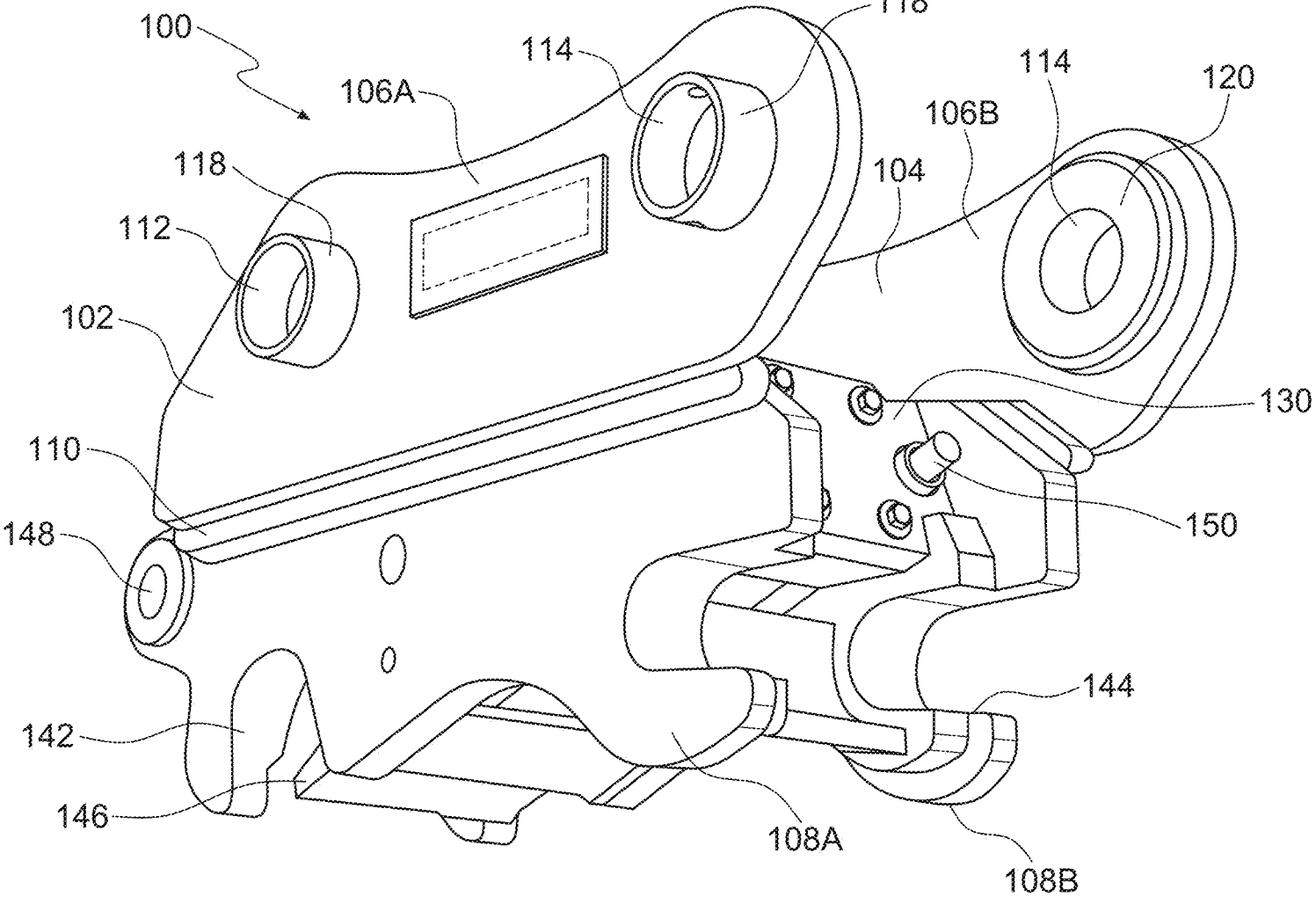
FIG. 1 is a perspective bottom side view of a pin grabber coupler.

As shown in FIG. 1, a dedicated pin grabber coupler 100 may comprise a pair of spaced-apart plates 102, 104. The coupler 100 may be constructed of a high-strength steel body. In this aspect, both the right plate 102 and the left plate 104 each have an upper plate 106 and a lower plate 108. The right upper plate 106A and the left upper plate 106B may be spaced-apart with a larger distance than the right lower plate 108A and the left lower plate 108B. The right upper plate 106A and the left upper plate 106B may be substantially parallel to each other. Similarly, the right lower plate 108A and the left lower plate 108B may be substantially parallel to each other. In some aspects, a stepped ridge 110 may separate each of the upper plates 106 from a corresponding each of the lower plates 108.

The upper plates 106 may each comprise one or more holes 112, 114 passing transverse through the plates 106. The holes 112, 114 may each receive a mounting pin (not shown) that fixes the coupler 100 to an excavator (not shown). In this aspect, a pair of rear retaining holes 112 and a pair of forward retaining holes 114 may each receive one of a pair of the mounting pins. In this aspect, the holes 112, 114 may have a flange 118 extending outward from each of the plates 106 around a circumference of each of the holes 112, 114. Each of the flanges 118 may have a locking hole (not shown) for placing a locking pin (not shown) therethrough in order to hold the retaining pins within the holes 112, 114. The holes 112, 114 may have a support 120 therearound extending inward from each of the plates 106. The support 120 may provide additional strength to the holes 112, 114. At the rear of the coupler 100 may be a lifting eye 148.

A housing 130 may be between the lower right plate 108A and the lower left plate 108B. In this aspect, the plates 108 may form two walls of the housing 130. The lower plates 108 may each form a rear receiving arch 142 and a forward receiving arch 144, also called the dedicated pin pickup 144. Shown particularly in FIG. 3, the rear receiving arch 142 may have a wedge lock 146 that may move across the rear receiving arch 142 in order to hold a pin 302 of the attachment (not shown). The wedge lock 146 may have a width generally corresponding to the distance between the lower plates 108A, 108B. In this aspect, the wedge lock 146 may move from an interior of the housing 130 to an exterior of the housing 130. The wedge lock 146 may be painted or coloured to be brightly contrasted to the rest of the coupler 100 in order to provide visual confirmation of proper engagement to an operator in a cab of the excavator. The wedge lock 146 may have a tapered end 160 that engages the pin 302 and holds the pin 302 within the rear receiving arch 142. Opposite to the tapered end 160 may be a latch engaging end 162 configured to secure a latch 206 that prevents motion of the wedge lock 146 as described in further detail below.

Figure 2:
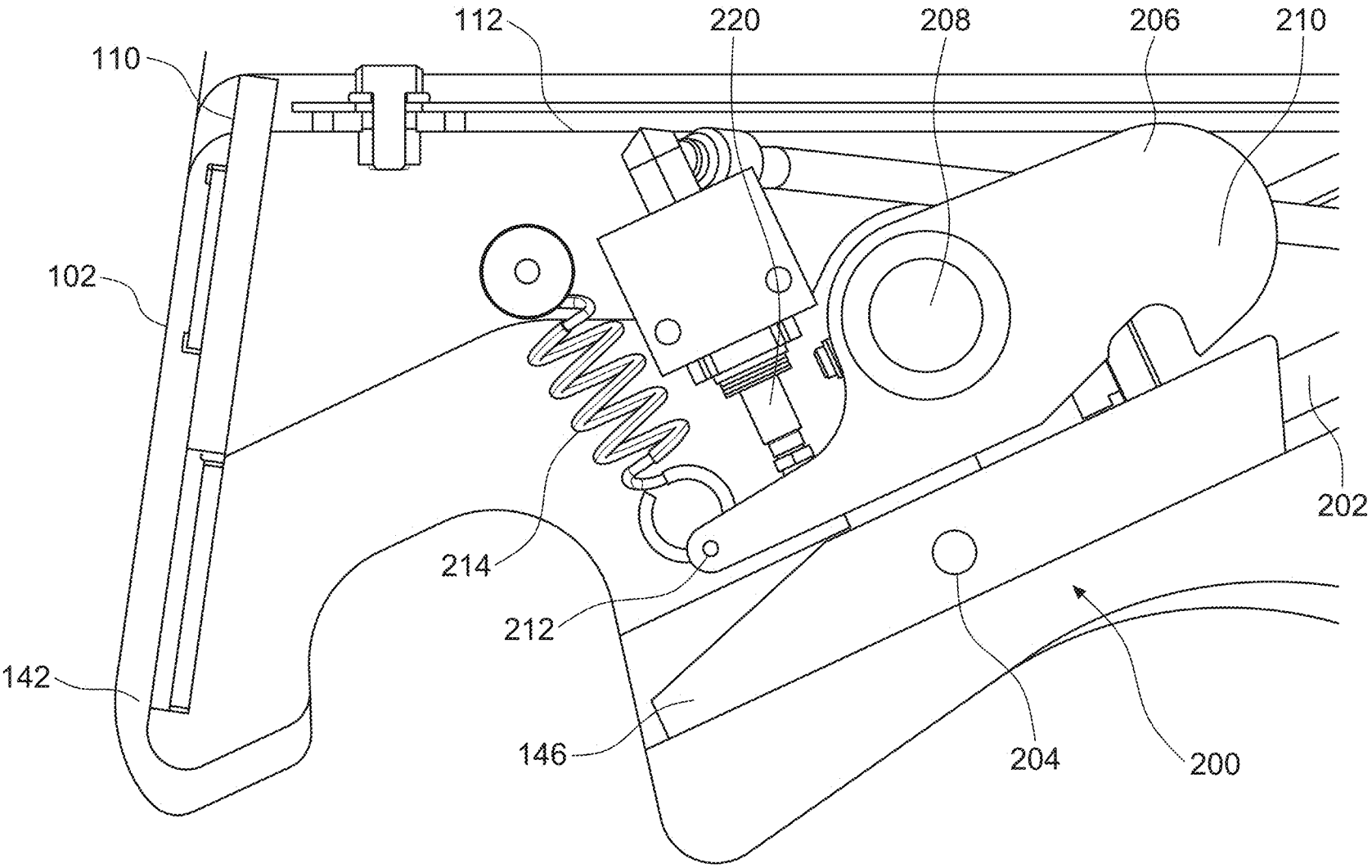
FIG. 2 is a cross-sectional side view of the pin grabber coupler in an unlocked configuration.
Figure 3:
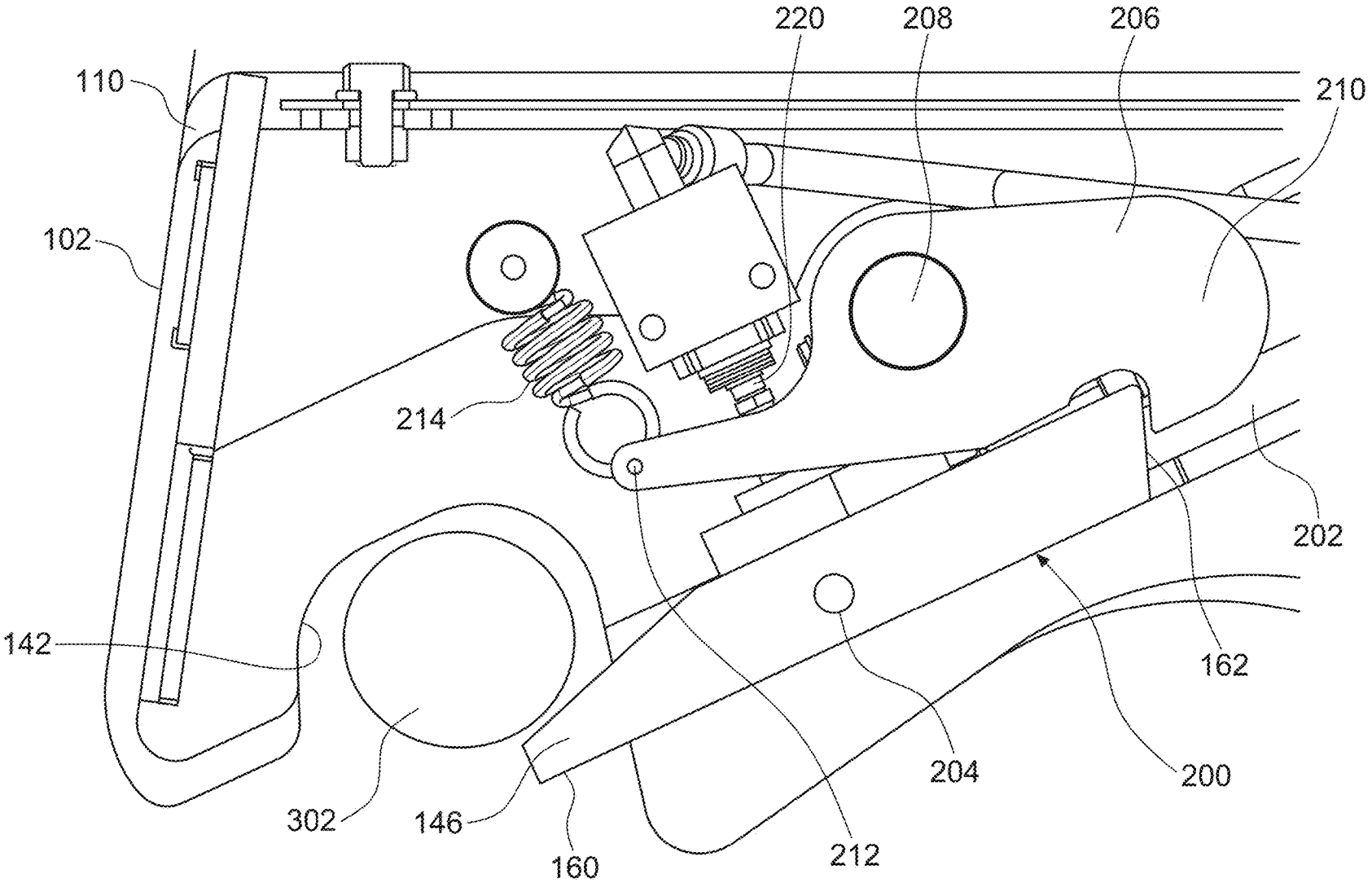
FIG. 3 is a cross-sectional side view of the pin grabber coupler in a locked configuration.

Turning to FIGS. 2 and 3, an internal locking system 200 may be configured to lock the wedge lock 146 around the pin 302 of the attachment. The internal locking system 200 may be within the housing 130 behind the forward receiving arch 144 and in front of the rear receiving arch 142.

FIG. 2 shows the internal locking system 200 in an unlocked configuration. The wedge lock 146 may be coupled to a main actuator 202, such as a hydraulic cylinder, using an attachment cylinder 204 at an attachment point (not shown). When the main actuator 202 is actuated, the drive cylinder 204 may be driven by a ram (not shown) of the actuator 202 towards the rear receiving arch 142. The drive cylinder 204 may contact a portion of the wedge lock 146 in order to drive the wedge lock 146 into or across the rear receiving arch 142.

In the unlocked configuration, a front visual indicator 150 may protrude from the housing 130. In this aspect, the front visual indicator 150 may be coupled to the wedge lock 146 such that when the wedge lock 146 is retracted, the visual indicator protrudes from the housing 130 and when the wedge lock 146 is fully extended into the rear receiving arch 142, then the visual indicator 150 is within the housing 130.

A latch 206 may be located generally above the drive cylinder 204. The latch 206 may rotate about an axis 208 or pivot transverse to the motion of the wedge lock 146. The latch 206 may have a latch end 210 and a lever end 212 with the rotational point therebetween. The lever end 212 may be coupled to an end of a biasing member 214, such as a spring, that causes the latch 206 to rotate about the axis 208 such that the latch end 210 may engage the wedge lock 146. The other end of the biasing member 214 may be coupled to the housing 130 such that tension is present on the spring. In another aspect, the other end of the biasing member 214 may be coupled to the housing 130 such that compression is present on the spring. An unlock actuator 220, such as a smaller hydraulic cylinder, may act on the lever end 212 of the latch 206 in order to cause the latch end 210 to disengage from the wedge lock 146.

Figure 4:
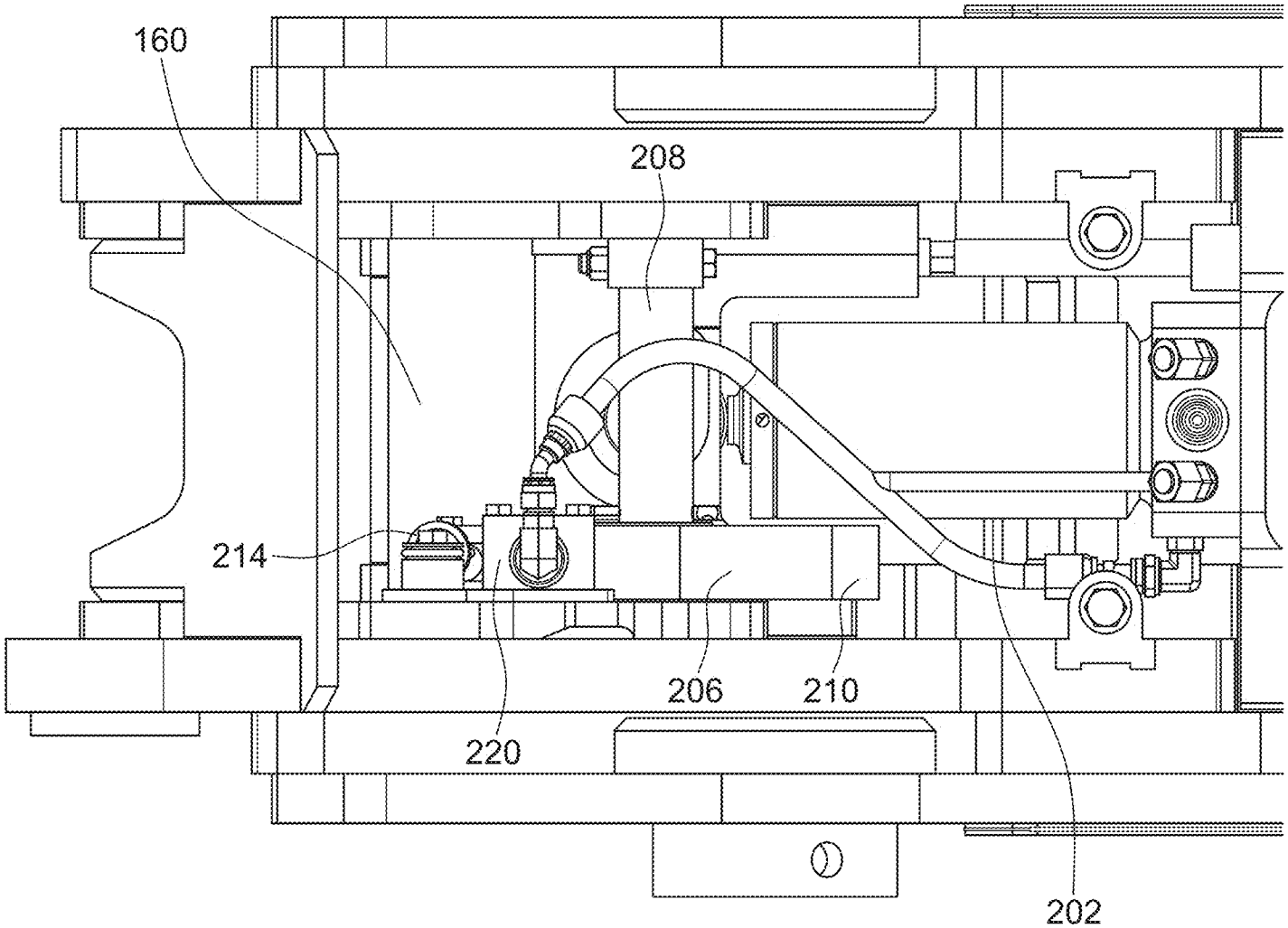
FIG. 4 is a cross-sectional top view of the pin grabber coupler.

FIGS. 3 and 4 show the internal locking system 200 in a locked configuration. In the locking configuration, the unlock actuator 220 may be retracted from the lever end 212 so that a minimal force is present on the lever end 212. The minimal force on the lever end 212 by the unlock actuator 220 may permit the biasing member 214 to rotate the latch 206 about the axis 208. The rotation of the latch 206 may cause the latch end 210 to engage the wedge lock 146 thereby locking or maintaining the wedge lock 146 within the rear receiving arch 142 and holding the pin 302 in position.

When the main actuator 202 fails and the wedge lock 146 is across the rear receiving arch 142, then the biasing member 214 acts on the lever end 212 to hold the latch end 210 against the wedge lock 146 in order to maintain the wedge lock 146 safely in position across the rear receiving arch 142. Similarly, when a dual failure occurs for both the unlock actuator 220 and the main actuator 202, then the biasing member 214 acts on the lever end 212 to hold the wedge lock 146 in a locked position. If only the unlock actuator 220 fails when the wedge lock 146 is in the unlocked position, the biasing member 214 may cause the latch end 210 to rest against the wedge lock 146. The latch end 210 engages the wedge lock 146 once the main actuator 220 moves an end of the wedge lock 146 past the latch end 210 and thereby maintaining the wedge lock 146 within the rear receiving arch 142.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A pin grabber coupler for coupling an attachment with an excavator, the pin grabber coupler comprising:
- a pair of spaced-apart plates;
- a housing at least between the spaced-apart plates;
- a rear receiving arch and a forward receiving arch formed by the spaced-apart plates for receiving a pin of the attachment;
- a wedge lock extending between the spaced-apart plates;
- a main actuator for driving the wedge lock into the rear receiving arch and for retracting the wedge lock from the rear receiving arch;
- a locking system for locking and for unlocking the wedge lock, the locking system comprising:
  - a latch having a latch end, a lever end, and a pivot therebetween; the latch end engaging the wedge lock once the wedge lock is fully extended into the rear receiving arch;
  - a biasing member coupled to the lever end and biasing the latch end towards the wedge lock; and
  - an unlock actuator for opposing the biasing member to disengage the latch end from the wedge lock,
- wherein the unlock actuator comprises a hydraulic cylinder for acting on the lever end of the latch.

2. The pin grabber coupler according to claim 1, wherein the biasing member comprises a spring coupled between the housing and the lever end.

3. The pin grabber coupler according to claim 1, wherein the main actuator comprises a hydraulic cylinder and a ram coupled to the wedge lock.

4. The pin grabber coupler according to claim 1, further comprising a visual indicator coupled to the wedge lock; when the wedge lock is retracted from the rear receiving arch, the visual indicator protrudes from the housing; and when the wedge lock is fully extended into the rear receiving arch, the visual indicator is within the housing.

5. The pin grabber coupler according to claim 1, wherein the wedge lock moves from an interior of the housing to an exterior of the housing by the main actuator.

6. The pin grabber coupler according to claim 1, wherein the wedge lock comprises a tapered end for engaging the pin of the attachment.

7. The pin grabber coupler according to claim 1, wherein the locking system is within the housing forward of the rear receiving arch and behind the forward receiving arch.

8. The pin grabber coupler according to claim 1, wherein each of the spaced-apart plates comprises an upper plate and a lower plate.

9. The pin grabber coupler according to claim 8, wherein the upper plates are spaced apart with a larger distance than the lower plates.

10. The pin grabber coupler according to claim 8, wherein the upper plates are substantially parallel to each other and the lower plates are substantially parallel to each other.

11. The pin grabber coupler according to claim 8, further comprising a stepped ridge separating each of the upper plates from a corresponding each of the lower plates.

12. The pin grabber coupler according to claim 8, wherein the upper plates comprise at least one hole, each of the at least one hole passing transverse through a corresponding one of the upper plates for receiving a mounting pin that fixes the pin grabber coupler to the excavator.

13. The pin grabber coupler according to claim 12, wherein the at least one hole comprises a pair of rear retaining holes and a pair of forward retaining holes.

14. The pin grabber coupler according to claim 12, wherein for each of the at least one hole, the upper plates comprise a flange extending outward from the corresponding one of the upper plates, the flange extending around a circumference of the each of the at least one hole.

15. The pin grabber coupler according to claim 8, wherein the housing is at least between the lower plates.

16. The pin grabber coupler according to claim 8, wherein the rear receiving arch and the forward receiving arch are formed by the lower plates for receiving the pin of the attachment.

* * * * *